US006267033B1

(12) United States Patent
Gundlach et al.

(10) Patent No.: US 6,267,033 B1
(45) **Date of Patent: *Jul. 31, 2001**

(54) CLOSE TOLERANCE FOOD SLICING APPARATUS, BLADE AND METHOD

(75) Inventors: Larry C. Gundlach, Madison; Gary R. Skaar, Marshall; Dennis G. Flisram, Plainfield; Kenneth J. Mepham, Poynette; Timothy Watson, Waunakee, all of WI (US)

(73) Assignee: Kraft Foods, Inc., Northfield, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/751,798

(22) Filed: Nov. 18, 1996

Related U.S. Application Data

(63) Continuation of application No. 08/328,213, filed on Oct. 25, 1994, now abandoned, which is a continuation-in-part of application No. 08/213,494, filed on Mar. 14, 1994, now Pat. No. 5,404,777, which is a continuation of application No. 07/968,622, filed on Oct. 29, 1992, now Pat. No. 5,320,014.

(51) Int. Cl.[7] ..... B26D 1/143

(52) U.S. Cl. ..... 83/42; 83/596; 83/676; 83/932

(58) Field of Search ..... 83/13, 42, 355, 83/437.1, 444, 596, 665, 666, 676, 932, 340, 342, 672; 30/357

(56) References Cited

U.S. PATENT DOCUMENTS

| | | | | |
|---|---|---|---|---|
| 1,679,508 | * | 8/1928 | Stukart . | |
| 1,957,623 | | 5/1934 | Walter . | |
| 2,472,876 | | 6/1949 | Ahrndt et al. . | |
| 2,931,407 | * | 4/1960 | Erickson . | |
| 3,286,569 | | 11/1966 | Hancock et al. | 83/174 |
| 3,299,925 | | 1/1967 | McBrady et al. . | |
| 3,799,013 | | 3/1974 | Long et al. | 83/56 |
| 3,799,019 | | 3/1974 | Long et al. | 83/342 |
| 3,824,885 | * | 7/1974 | Marshall et al. . | |

(List continued on next page.)

FOREIGN PATENT DOCUMENTS

| | | | |
|---|---|---|---|
| 941251 | * | 7/1949 | (DE) . |
| 1193652 | * | 5/1965 | (DE) . |
| 754472 | * | 11/1933 | (FR) . |
| 227331 | * | 1/1925 | (GB) . |

*Primary Examiner*—Kenneth E. Peterson
(74) *Attorney, Agent, or Firm*—Cook, Alex, McFarron, Manzo, Cummings & Mehler, Ltd.

(57) ABSTRACT

Apparatus device and method improved slicing of large food sticks, loaves and the like are provided. A slicing blade which may have a top flat surface or top flat land width along its cutting edge provides generally longitudinal forces on the food product being sliced, which forces are in a direction generally opposite to the direction through which the food products are fed through a slicing apparatus. The slicing blade includes a bottom primary bevel surface and typically steep primary angle for imparting angularly directed forces on the food products being sliced so as to throw the slices at a generally corresponding deposit angle. The invention is particularly important in improving handling of large luncheon meat sticks including non-frozen, high water content and reduced fat content luncheon meat sticks. Fast feed rates can be practiced without experiencing jamming, yields are increased, slice quality is made more consistent and repeatable, slicing line utilization is enhanced, and sanitary conditions are more easily maintained.

46 Claims, 2 Drawing Sheets

U.S. PATENT DOCUMENTS

| | | | | |
|---|---|---|---|---|
| 3,921,485 | | 11/1975 | Tobey et al. | 83/342 |
| 3,969,966 | | 7/1976 | Dillon | 83/340 |
| 4,428,263 | * | 1/1984 | Lindee et al. | 83/355 X |
| 4,523,505 | * | 6/1985 | Polson . | |
| 4,685,364 | * | 8/1987 | Scheflow et al. | 83/355 X |
| 4,805,503 | * | 2/1989 | Yokokawa | 83/355 |
| 4,854,204 | | 8/1989 | Faltin | 83/500 |
| 4,907,920 | | 3/1990 | Lund et al. | 409/132 |
| 5,136,908 | * | 8/1992 | Callandrello | 83/666 X |
| 5,320,014 | | 6/1994 | Skaar et al. | 83/42 |

* cited by examiner

CLOSE TOLERANCE FOOD SLICING APPARATUS, BLADE AND METHOD

CROSS REFERENCE TO RELATED APPLICATION

This application is a continuation of application Ser. No. 08/328/,213, filed Oct. 25, 1994, now abandoned, which is a continuation-in-part of application Ser. No. 08/213,494, filed Mar. 14, 1994, U.S. Pat. No. 5,404,777 which is a continuation of application Ser. No. 7/968,622, filed Oct. 29, 1992, U.S. Pat. No. 5,320,014.

DESCRIPTION

BACKGROUND AND DESCRIPTION OF THE INVENTION

The present invention generally relates to the slicing of food products and more particularly to a method and apparatus for conducting such slicing on food products such as large meat sticks. The invention involves feeding a meat stick or the like toward, into and through a slicer having a blade with specific attributes. The blade allows for slicing which is of improved quality consistency and carries out slicing operations which are of enhanced repeatability. Meat sticks are thus handled even at particularly fast feed rates and without experiencing jamming, reduced yields, or poor slicing equipment utilization which are typically experienced when slicing large meat sticks through industrial slicing machinery. Improved product quality also results. The advantages of the invention are especially evident when the food sticks are of the low-fat and/or high water content types, whether unfrozen or frozen.

With certain products such as food products that are processed in large sticks, blocks, chubs, loaves or the like, it is often desirable to handle these large masses in any of the refrigerated but unfrozen, frozen or partially frozen states. Various reasons for processing under the latter two of such conditions include ease of manipulation of the sliced products so as to form neat stacks of slices due to the fact that frozen or partially frozen slices will present low friction interfaces with each other whereby they are readily moved into alignment. Refrigerated but non-frozen food products such as luncheon meats for example sever into slices which are difficult to mechanically move once one slice engages another slice or other surface, thereby rendering extremely difficult the neatening of stacks which are produced by conventional slicing equipment. Nevertheless, at times it becomes necessary to reduce freezing. Unfrozen products can be difficult to slice at high speeds without causing damage to the slices, such as tearing, and these difficulties are usually heightened when the food product stick has a high moisture content and/or a low or reduced fat content.

Attempts have been used in the past for rapidly slicing these types of products, but the yields have been disappointingly low and the waste hag been greater than desired. Improvements in yields and waste factors often can be gained by significantly reducing the feeding speed of the slicing apparatus. This results in inefficient utilization of the slicing equipment when compared with the potential efficiencies of a truly efficient and high speed feeding approach.

An approach which has been attempted in seeking to capture the potential efficiencies of improved feed arrangements includes the use of a so-called orifice assembly. An orifice assembly is intended to support (primarily laterally) a food stick or the like as it passes through the slicer. Typically, an orifice assembly includes a cylindrical member or other member having a peripheral shape corresponding to that of the stick or the like being sliced. This cylindrical or similarly shaped member has a leading edge which is very closely spaced from the slicing blade and is intended to provide some support for the stick during slicing. Some approaches suggest using orifices having smooth inside surfaces, while others suggest somewhat irregular surfaces for contacting the sticks or the like. Pressure applied to the sticks can be adjusted in an effort to better hold the butt; however, if too much pressure is applied, the hide can be squeezed off of the product by the orifice assembly, rendering the product unacceptable, and still have uncontrolled butt end pull through subsequently resulting in product jams.

It has been found that the use of an orifice assembly alone does not remedy the problems associated with high speed commercial product slicing, especially insofar as butt end pull through and slicer jamming and disappointing yield and waste experiences are concerned. Typically about ½ inch to 8 linear inches, sometimes up to about 12 inches, of the butt end of the stick can be lost. Another consequence of frequent jams and pull through is associated with the need for an operator to interact with the slicer such as by using a hand to remove a jammed butt end, creating a condition that can lead to potential reduction of sanitary conditions, which can shorten the shelf life of the sliced products.

It has been found that by providing an improved slicing blade, significant improvements in slicing of food products, particularly luncheon meat sticks or loaves, are attained. By the approach in accordance with the present invention, the yield of high quality, commercially processable and packageable sliced product is enhanced considerably and the quantity of product waste is reduced significantly. Furthermore, operational characteristics and consistency of the slicing devices are enhanced. More particularly, by proceeding in accordance with the present invention, it is possible to slice frozen, partially frozen or refrigerated but unfrozen food sticks on a truly efficient basis and at enhanced feed and slicing rates without incurring the inefficient and serious problems of slice tearing and/or jamming of the slicing equipment such as by having the slicing equipment pull a severed chub out of the orifice assembly as a large chunk of product that cannot be adequately handled by the slicing blade, resulting in jamming of the slicing equipment. Jamming, of course, necessitates a shut-down of the slicing line and perhaps associated machinery upstream and/or downstream of the slicing line in order to clear the jam, often requiring manual intervention by an operator, which can itself reduce the shelf life of the sliced product. Meat products which have high moisture contents and/or low fat contents are especially difficult to slice at high speeds.

In summary, the present invention achieves these objectives and provides advantageous results along these lines by processing large food sticks, loaves and the like at a relatively fast feed rate, with greater quality consistency and in a more repeatable fashion. The blade of the invention features a relatively large primary bevel angle and a relatively wide top land width. It also preferably has an especially tight flatness tolerance along the area of the blade. Blades having properties along these lines have been found to control butt pull-through at the slicer and has been found to significantly increase yield and reduce waste of and/or damage to the products being sliced, while enhancing slicing line utilization, consistency and control.

It is a general object of the present invention to provide an improved blade, method and apparatus for slicing large food products in the form of sticks, chubs, loaves, chunks and the like.

Another object of this invention is to provide an improved slicing blade and method and apparatus which include the use of slicing blades having bevel angles, flat land width surfaces and flatness qualities which improve slicing quality, consistency and speed.

Another object of this invention is to provide an improved blade, method and apparatus for slicing food products in order to improve the yield of product processed through a slicer in a frozen, partially frozen or refrigerated and unfrozen state while tolerating relatively fast slicing speeds.

Another object of the present invention is the achievement of high performance especially with slicing of high moisture, non-frozen, reduced-fat and/or low fat products.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
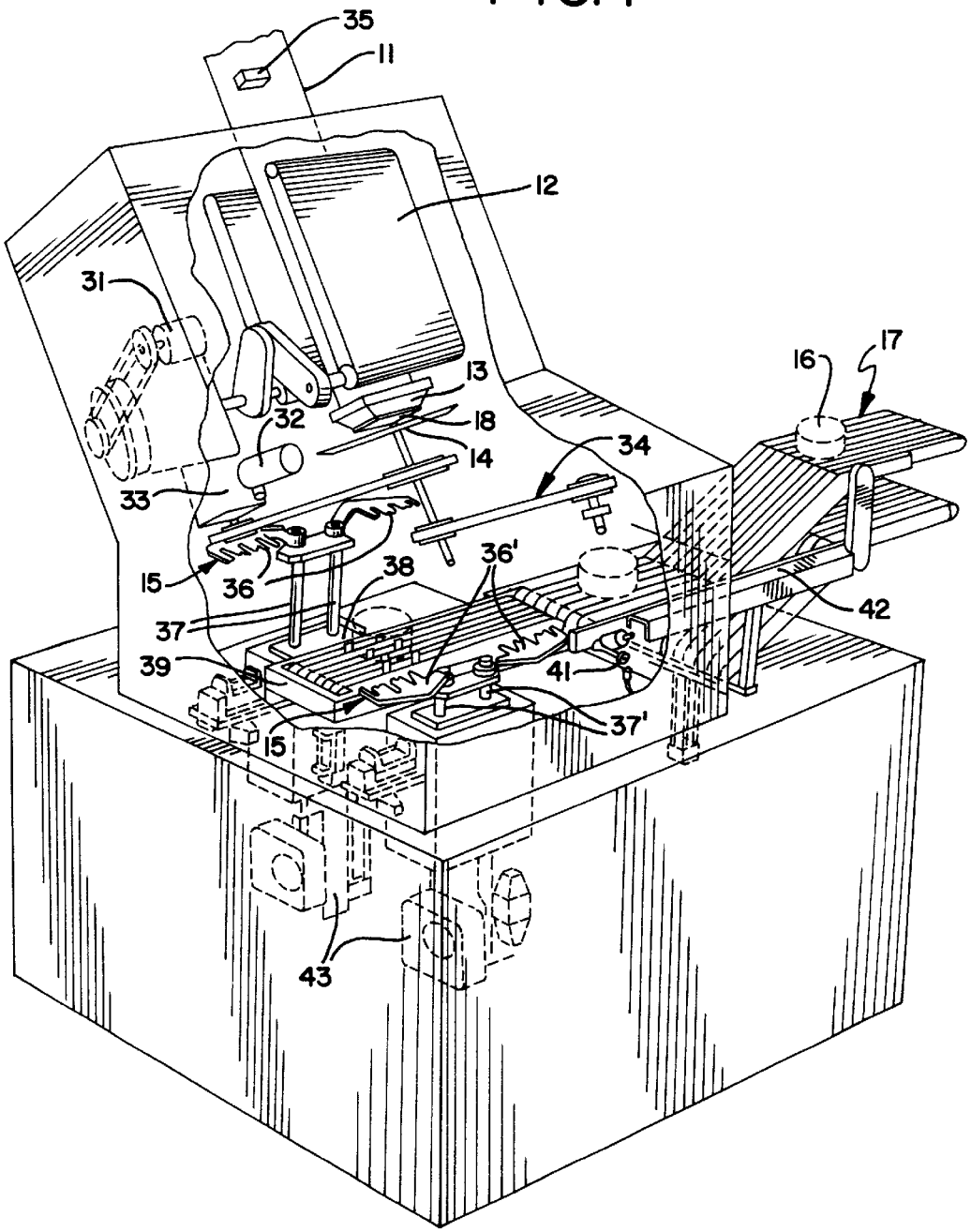
FIG. 1 is a perspective view, partially broken away, of a type of slicing apparatus within which a blade according to the present invention may be incorporated.

An apparatus for feeding food sticks, rolls, loaves, chubs, chunks or the like, for severing same into slices, and for collecting the slices into a plurality of stacks is generally shown in FIG. 1. This is illustrative of the type of apparatus within which blades according to the invention may be incorporated. A stick of product 11 is generally shown within a feeding assembly 12 of generally known construction, further details of the illustrated feeding assembly 12 being shown for example in FIG. 5 of U.S. Pat. No. 5,320,014, incorporated by reference hereinto. Each stick 11 food product is fed by the feeding assembly 12 to an orifice assembly 13 in this particular apparatus. The fed food product is brought into engagement with a slicing blade 14. Product slices accumulate on a catcher assembly, generally designated as 15. Sliced stacks 16 collect on a conveyor assembly, generally designated 17.

Figure 2:
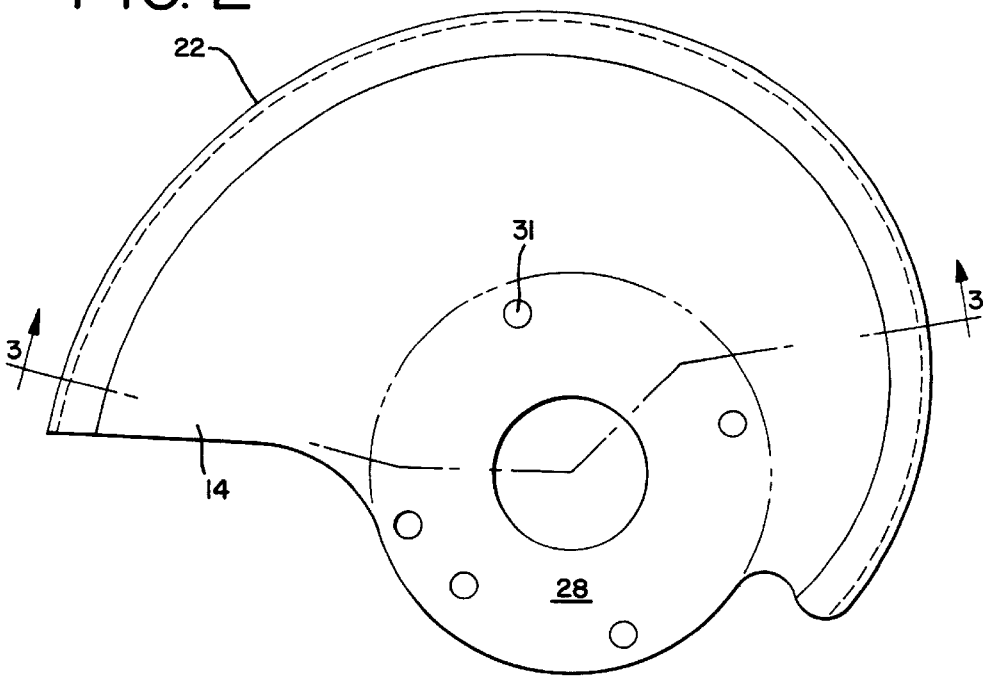
FIG. 2 is a plan view of a typical slicing blade incorporating the present invention.
Figure 3:
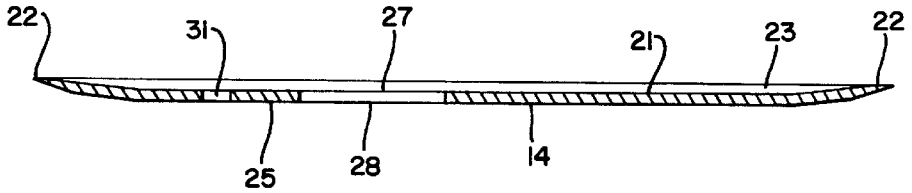
FIG. 3 is a cross-sectional view taken along line 3—3 of the blade illustrated in FIG. 2.
Figure 4:
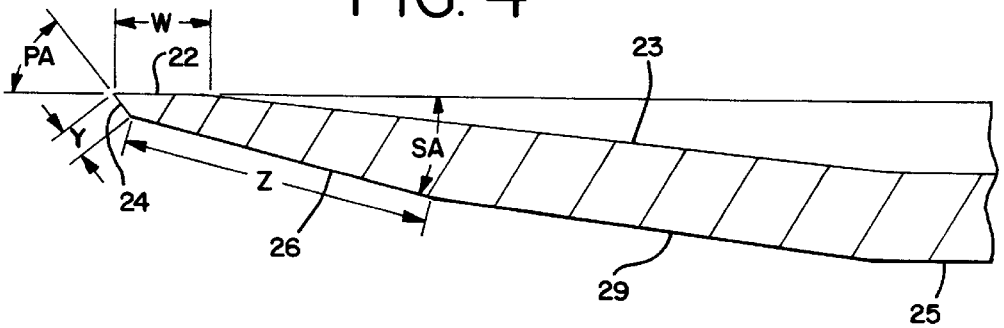
FIG. 4 is an enlarged view of the working edge of the blade shown in FIG. 2 and FIG. 3.

Stick 11 is severed by slicing blade 14 at a location closely adjacent to and only slightly spaced from lip 18 of the illustrated orifice assembly 13. As illustrated in FIGS. 2 through 4, working side 21 of the slicing blade 14, which is the side of the blade that faces food product 11 during the slicing operation, includes a body portion and a flat top surface or top flat land width 22 which is virtually parallel to the cut surface of the food product 11 being sliced. Body portion of working side 21 of the slicing blade 14 is generally dish-shaped or somewhat concave whereby a clearance area 23 (FIGS. 3 and 4) is provided between the food product 11 being sliced and the slicing blade 14, particularly the body portion of its working side 21, while the top flat land width 22 is in contact with the food product 11 as it is being sliced. The formation of a slice, including the interaction between the food product 11 and the various surfaces of the edge portion of the slicing blade 14 includes having the slice eventually thrown by the blade 14 slicing through the food stick 11.

Edge portion of the slicing blade 14 is shown in greater detail in FIG. 4. The top flat surface or top flat land width 22 is in the nature of a flat band that has an average width "W". It will be appreciated that top flat surface 22 is formed by a grinding operation. Because of the relatively large periphery and relatively thin thickness of the slicing blade 14, it is difficult to provide a top flat surface 22 that is of uniform width throughout its extent. The average width "W" is determined by measuring the width of the top flat surface 22 a plurality of times, the measurements being one inch apart along the extent of the top flat surface 22. These measurements are then totalled and divided by the number of measurements in order to obtain the average width. In order that the top flat surface 22 provides adequate support to hold the food product 11 during slicing, the average width should be between about 0.1 inch and about 1 inch. A typically preferred average width is between about 0.2 inch and about 0.5 inch. Especially preferred is an average width of 0.275 inch, ranging between about 0.3 inch and about 0.24 inch, an especially preferred width being 0.275 inch ±0.030 inch. The blade of the invention exhibits reduced pull on the food sticks during slicing, when compared with other slicing mechanisms.

Also included is a primary bevel surface 24 or bottom land width at the primary angle. The top flat land width 22 and the bottom primary bevel surface 24 intersect each other at a primary angle "PA". The back side 25 of slicing blade 14 includes a secondary bevel surface 26 or bottom land width at the secondary angle.

Primary bevel surface will typically have an average width "Y" which ranges between about 0.025 inch and about 0.200 inch, preferably between about 0.050 inch and about 0.150 inch, and most especially between about 0.050 inch and about 0.080 inch, a particularly preferred width being about 0.060 inch ±0.010 inch. A range for the primary angle "PA" is between about 28° and about 65°. It has been found to be important that this primary angle be especially steep, preferably between about 35° and about 60°, most preferably between about 45° and about 55°, a particularly preferred primary angle PA being about 50°±0.5°. The secondary bevel surface 26 has a width "Z" of between about 1 inch and 2 inches, preferably about 1.5 inch ±0.125 inch. The angle of the secondary bevel surface 26 with respect to the top surface or flat top surface 22 of the blade, or the secondary angle "SA", is typically between 0° and about 30°, preferably between about 10° and about 20°, an especially preferred angle being about 15°+1°. It will be appreciated that the actual values of these parameters may vary somewhat depending upon the product being sliced.

Also of substantial importance to the principles of the invention is a flatness characteristic of the slicing blade 14. In essence, substantially the entirety of at least the cutting edge of the blade lies along substantially the same flat plane such that no portion of the cutting surface varies (with respect to such plane) from any other portion of the cutting surface by a distance greater than 0.150 inch. In other words, the flatness tolerance for the working surface of the slicing blade is 0.150 inch from a precise parallel condition. This tolerance typically should be equal to or less than about 0.050 inch, preferably equal to or less than about 0.015 inch, most preferably equal to or less than about 0.010 inch.

In addition, the mounting hub or portion of the blade, at both its front or top surface 27 and its back or bottom surface 28, is preferably ground flat and parallel to the working surface of the blade. This assures that the blade, when properly mounted within a slicing apparatus, will present its cutting surface in a "square" or "true" manner whereby the cutting surface of the rotating blade will remain in virtually the same plane and will not exhibit any appreciable unevenness of motion while the blade is rotating.

Blade 14 typically includes a tertiary bevel surface 29. Generally speaking, its width and the value of the tertiary angle which it defines will be determined by the other parameters of the blade. Typically, the tertiary angle will be shallower then each of the primary angle PA and secondary angle SA. Often, the width of tertiary bevel surface 29 will be greater than each of the primary bevel surface 24 and secondary bevel surface 26. Each mounting hole 31 will be drilled perpendicular to the surface and suitably sized and spaced depending on the slicing equipment within which the blade is to be mounted.

Each blade is honed or sharpened to have a good sharpness rating. For example, a sharpness measurement device will engage the working edge of the blade at about four different locations or intervals, excluding the first inch and last inch of the cutting surface. When using a measurement device or sharpness meter as disclosed in U.S. patent application Ser. No. 065,091, filed May 20, 1993, the average of the four readings should be 3.2 pounds or less, preferably 2 pounds or less. After honing or sharpening, the widths of the various bevel surfaces are checked, typically while excluding measurements along the first inch and last inch of the cutting surface.

The advantageous effect of the combination of the present invention includes the momentum imparted to each slice as the blade cycles entirely through the food stick 11 and the slicing blade 14 slices entirely through the stick of meat 11 by the time the longest leg of the blade 14 has rotated into the food stick 11. Once the blade has rotated through its slicing phase, as well known in the art, the slice 19 is completely severed from the food stick 11.

The combination of features of the slicing blade 14 cooperate to rapidly throw down each slice due in large measure to the relatively steep angle of the primary angle and substantial width of the primary bevel surface 24. For example, a primary bevel angle of 50° for a slicing blade 14 as shown throws each slice down through an angle of about 45° from the stick surface being cut. A result is a rapid transfer of freshly cut slices to the stack being formed, which occurs more rapidly than when a flatter bevel angle is provided. For example, an otherwise substantially identical blade but with a primary bevel angle of 30° would throw each slice at about a 25° angle, and the slice falls less rapidly due to greater air resistance and the increased path of travel for these slices when compared with slices made with a blade having a much steeper primary bevel angle.

Another instance of advantageous aspects of the combination is that the flat top surface or top flat land width 22 provides a superior holding force upon the food stick 11. Similarly, a force is applied onto the food stick 11 by the orifice assembly 13 in a direction substantially normal to the holding force imparted by the top flat land width. It is believed that these forces combine to enhance the advantages achieved by the present invention. It was observed, for example, that these forces support even the butt end which remains during the slicing of a food stick whereby same is sliced more thoroughly than practiced heretofore. Moreover, this is accomplished even in those instances where the butt end is engaged by and is pushed into the slicing device by a following food stick which is within the feeding assembly 12. In accordance with the present invention, the slicing blade 14 contacts the food stick 11 and remains in contact with it for a length of time greater than accomplished heretofore. It is important that the flat top surface 22 have an average surface area or width that is adequate to support the product in achieving this advantage of the invention.

The downward force imparted to the food stick 11 and/or food butt 29 by the primary bevel angle "PA" is controlled by the invention. Otherwise, this downward force can result in uncontrolled movement of the food product during slicing, particularly when that food product is a butt end 29. This uncontrolled movement results in lower slicing yields, slicer jam-ups, poor slicing line utilization, and a potentially reduced shelf life for the sliced products. Problems of these types are particularly evident in commercial slicers such as illustrated generally in FIG. 1 which are sold commercially by Formax, Inc. for continuous slicing and which experience these difficulties including butt pull-through and poor slice shape. To a certain extent, these difficulties can be reduced by reducing the speed of operation of the slicing equipment, which, of course, is an example of poor slicing line utilization.

The invention is especially advantageous because it can accommodate even fragile, soft products which can have relatively high water contents. Examples include chicken, smoked turkey, ham and low-fat, reduced-fat and/or relatively high water content versions of these meats and others. It is often desirable to slice same when at refrigerated, but higher in temperature than frozen, temperatures; usually these meat sticks would be at a temperature between about 24° F. and about 36° F. The invention is also suitable for frozen or partially frozen sticks. These frozen or partially frozen sticks are at a temperature equal to or less than about 22° F., typically between about 10° F., and about 22° F., often between about 16° F. and about 22° F. Generally, the temperature will thus range between about 10° F. and about 36° F., depending upon the product and desired operation parameters.

Depending upon the makeup of the stick and the conditions under which it was subjected to a low temperature environment, a stick could be of generally uniform temperature throughout or could be lower in temperature at its rind or crust or at its center. Thus, these temperatures will vary somewhat depending on actual conditions and products.

With respect to the types of slicing mechanisms and blades therefor, besides the involute slicing blade 14 shown in the drawings, other systems can be used. The equipment can be of a general spiral type, can be round, or can be designed so its cutting speed varies along the cutting surface by varying the cutting angle usually at the end and/or the beginning of the cutting rotation. The blades and slicers can be of styles such as those available from Formax, Cashin, Anco, Cozzini, Thurne, Great Lakes and others.

Blades having a multiple cutting surface such as those illustrated in U.S. Pat. No. 5,065,656, incorporated by reference hereinto, can include the features of the invention. Each revolution of the blade severs more than one slice, for example two slices for each revolution of a double cutting surface blade. Other slicing equipment utilize a circular blade which operates in a generally orbital path in order to provide a severance mode and a gap between severance modes whereby the product being sliced is moved into the path of the blade between actual slicing. Devices of these types are known in the art.

It can be desirable to coat any of these blades with materials that have a lower coefficient of friction than, for example, stainless steel, in order to reduce drag between the blade and the product being sliced. This can enhance the neatness of the stacks initially made by the slicer. Coatings can also increase the working life of the blade between needed sharpenings and can also retard rusting and/or corrosion. A typical coating in this regard is or includes titanium nitride.

FIG. 1 illustrates one of the types of slicing devices that can advantageously practice the present invention. A known blade driving mechanism, partially broken away, is illustrated as including a feed encoder 31, a stepping motor 32, a variator 33, and drive components generally designated 34 including a brake mechanism. A sensor or switch 35 is provided for detecting the location of sticks 11 passing through the feeding assembly 12.

Catcher assembly 15 includes a plurality of stacking grids or indexing platforms 36, 36'. The stacking grids 36, 36' move between the up position of the backside grids as shown in FIG. 1 and the down position of the front side grids 36'. Also, the grids 36, 36' rotate along the respective axes of their support rods 37, 37' so that one of the pairs of grids is out of the travel path of the slices while the other pair of grids is receiving the stack being formed and moving toward depositing the formed stack onto protruding pins 38 which typically serve as a platform for a scale mechanism. A scale conveyor 39 operates in a generally known manner by pivoting an axis 41 to thereby lift a formed stack off of the protruding pins 38 in order to convey same onto downstream conveyor assembly 42.

Grid encoders 43 assist in the operational timing of the unit. An adjusting mechanism is available for modifying the pressure exerted on the stick 11 by the orifice 13. Generally speaking, orifice 13 includes components, such as split halves, which move laterally with respect to the stick in order to thereby modify the pressure applied by the orifice assembly 13 in a generally known manner.

Concerning the method in accordance with the invention, the food stick is sliced in a very consistent and controlled manner and at fast slicing speeds which will vary somewhat depending upon the particular slicing equipment being used. Slicing speeds in excess of 500 slices per minute are readily achieved while effecting exceptionally reproducible slicing. Included are speeds of up to the maximum slicing speed of the particular slicer, which can be 1500 or more slices per minute. These speeds vary depending upon the slicing equipment and the food product being sliced. In any event, the speed is significantly greater for blades according to the invention when compared with prior art blades when slicing the same product under the same conditions. In addition, product tears are fewer and slice quality is better when the present blades are utilized.

The method includes having the top flat surface impart generally longitudinally directed support of the stick during slicing, while the bottom primary bevel surface and the primary angle effect a step of angularly engaging the food stick being sliced so as to cause each slice to be thrown downwardly at a deposit angle which is typically slightly less (by approximately 5°) than the primary angle. The bottom profile of the blade also cooperates with the rest of the blade to achieve the advantageous results discussed herein.

Another advantage of the invention and method is its ability to slice in a consistent and fast manner any variety of food products such as large luncheon meat sticks. They may be frozen, partially frozen or refrigerated and unfrozen. The advantages of the invention are realized even when particularly difficult to slice meat sticks are handled. For example, the method readily handles slicing of meat sticks of the low fat or reduced fat varieties, such as those having fat contents at 10weight percent or below, based on the weight of the stick, and even as low as 5 weight percent and below. Also food products or sticks that are formulated in taste-enhancing fashion such as by having relatively high water contents, for example at about 70 weight percent and above, are efficiently and rapidly sliced into slices of high consistency in slice thickness and/or weight and with reduced tearing when compared with blades not incorporating the features of the invention. Water weight percents for these types of products can be added to in order to equal or exceed 100% by weight, based on the weight of the food product prior to water addition.

It will be understood that the embodiments of the present invention which have been described are illustrative of some of the applications of the principles of the present invention. Numerous modifications may be made by those skilled in the art without departing from the true spirit and scope of the invention.

What is claimed is:

1. An apparatus for slicing food sticks, comprising:

a slicing assembly for severing large sliceable food sticks into slices and stacking said slices into stacks of slices;

means for feeding a food stick to the slicing assembly;

an orifice assembly for receiving and generally laterally supporting a leading portion of said food stick during slicing, said orifice assembly having an opening through which said food sticks pass;

said slicing assembly has a blade member, said blade member engages said food stick and severs said food stick into said slices, said blade member having a non-severing body portion and a severing edge portion having a flat portion defining an outermost perimeter edge of said edge portion;

said flat portion of the edge portion of the blade member is a top flat surface which engages said food stick and is generally parallel to the cut surface of the food stick being sliced, said top flat surface having an average width adequate to impart a holding force to generally longitudinally support said food stick which it engages when said blade member severs the food stick into slices, said average width of the top flat surface being not less than about 0.1 inch;

said edge portion further having a bottom primary bevel surface which, together with said top flat surface, defines a primary angle, said primary angle being between about 45° and about 60°; and said apparatus is adapted to slice any of frozen, partially frozen and refrigerated food sticks at a temperature between about 10° F. and about 36° F.

2. The apparatus in accordance with claim 1, wherein said non-severing body portion of the blade member has a hub portion having a top surface and a bottom surface, and wherein said top surface and said bottom surface are each parallel to said top flat surface.

3. The apparatus in accordance with claim 1, wherein said bottom primary bevel surface has an average of between about 0.025 inch and about 0.200 inch, said average width of the top flat surface is not less than about 0.2 inch, said blade member further includes a bottom secondary bevel surface located radially inwardly of said bottom primary bevel surface, and said bottom secondary bevel surface defines, together with said top flat surface, a secondary angle of between about 0° and about 30°.

4. The apparatus in accordance with claim 1, wherein said primary angle is about 50°±0.50°.

5. The apparatus in accordance with claim 1, wherein said bottom primary bevel surface has an average width of between about 0.025 inch and about 0.200 inch.

6. The apparatus in accordance with claim 1, wherein said bottom primary bevel surface has an average width of between about 0.050 inch and about 0.150 inch.

7. The apparatus in accordance with claim 1, wherein said bottom primary bevel surface has an average width of between about 0.050 inch and about 0.080 inch.

8. The apparatus in accordance with claim 1, wherein said bottom primary bevel surface has an average width of about 0.060 inch ±0.010 inch.

9. The apparatus in accordance with claim 1, wherein said average width of said top flat surface is not less than about 0.2 inch.

10. The apparatus in accordance with claim 1, wherein said average width of said top flat surface is between about 0.1 inch and about 1 inch.

11. The apparatus in accordance with claim 1, wherein said average width of said flat top surface is between about 0.2 inch and about 0.5 inch.

12. The apparatus in accordance with claim 1, wherein said edge portion further includes a bottom secondary bevel surface located radially inwardly of said bottom primary bevel surface which, together with said top flat surface, defines a secondary angle, and said secondary angle is between about 0° about 30°.

13. The apparatus in accordance with claim 12, wherein said secondary angle is between about 10° and about 20°.

14. The apparatus in accordance with claim 12, wherein said secondary angle is about 15°±1°.

15. The apparatus in accordance with claim 12, wherein said bottom secondary bevel surface has an average width of between about 1 inch and about 2 inches.

16. The apparatus in accordance with claim 12, wherein said bottom secondary bevel surface has an average width of about 1.5 inch ±0.125 inch.

17. The apparatus in accordance with claim 1, wherein said severing edge portion of the blade member has a flatness characteristic such that substantially the entirety of said severing edge portion is spaced along a flat plane such that said severing edge portion is spaced apart from said flat plane by a tolerance distance not greater than about 0.050 inch.

18. The apparatus in accordance with claim 17, wherein said tolerance distance is equal to or less than about 0.015 inch.

19. The apparatus in accordance with claim 17, wherein said tolerance distance is between about 0.005 and about 0.015 inch.

20. An apparatus for slicing food sticks comprising:

a slicing assembly for severing large sliceable food sticks into slices and stacking said slices into stacks of slices;

means for feeding a food stick to the slicing assembly;

said slicing assembly has a blade member, said blade member engages said food stick and severs said food stick into said slices, said blade member having a non-severing body portion and a severing edge portion having a top portion defining an outermost perimeter edge of said edge portion;

said flat portion of the edge portion of the blade member engages said food stick and is generally parallel to the cut surface of the food stick being sliced;

said edge portion further having a bottom primary bevel surface which, together with said top flat surface, defines a primary angle, said primary angle being between about 45° and about 60°; and said severing edge portion of the blade member has a flatness characteristic such that substantially the entirety of said severing edge portion is spaced along a flat plane such that substantially the entirety of said severing edge portion is spaced apart from said flat plane by a tolerance distance of not greater than about 0.050 inch.

21. The apparatus in accordance with claim 20, wherein said bottom primary bevel surface has an average width of between about 0.025 inch and about 0.200 inch.

22. The apparatus in accordance with claim 20, wherein said bottom primary bevel surface has an average width of between about 0.050 inch and about 0.080 inch.

23. An apparatus for slicing food sticks, comprising:

a slicing assembly for severing large sliceable food sticks into slices and stacking said slices into stacks of slices;

means for feeding a food stick to the slicing assembly;

an orifice assembly for receiving and generally laterally supporting a leading portion of said food stick during slicing, said orifice assembly having an opening through which said food sticks pass;

said slicing assembly has a blade member, said blade member engages said food stick and severs said food stick into said slices, said blade member having a non-severing body portion and a severing edge portion having a top portion defining an outermost perimeter edge of said edge portion;

said top portion of the edge portion of the blade member engages said food stick being sliced; and said severing edge portion further having a bottom primary bevel surface which, together with said top portion, defines a primary angle, said primary angle being between about 45° and about 60°.

24. The apparatus in accordance with claim 23, wherein said severing edge portion of the blade member has a flatness characteristic such that substantially the entirety of said severing edge portion is spaced along a flat plane such that said severing edge portion is spaced apart from said flat plane by a tolerance distance not greater than about 0.050 inch.

25. The apparatus in accordance with claim 24, wherein said tolerance distance is equal to or less than about 0.015 inch.

26. The apparatus in accordance with claim 23, wherein said primary angle is about 50°±0.5°.

27. The apparatus in accordance with claim 23, wherein said bottom primary bevel surface has an average width of between about 0.025 inch and about 0.200 inch.

28. The apparatus in accordance with claim 23, wherein said bottom primary bevel surface has an average width of between about 0.050 inch and about 0.080 inch.

29. A method for slicing a stream of food sticks, comprising the steps of:

feeding, with the use of a feed assembly, a plurality of large food sticks toward and into a slicing location of a slicing assembly;

slicing at the slicing location the food sticks fed during the feeding step, said slicing step forming slices and a butt end from the food stick;

said slicing step including engaging in a portion of the food stick being sliced with a blade having a top flat surface substantially parallel to the food stick cut surface being sliced, the engaging step providing generally longitudinally directed support of each food stick by the top flat surface during slicing of each food stick, said top flat surface having an average width of at least about 0.1 inch;

said slicing step further including angularly engaging the portion of the food stick being sliced with a bottom primary bevel surface of the blade, the bottom primary bevel surface, together with the top flat surface, defining a primary angle of between about 45° and about 60°, the angularly engaging steps causing each slice to be thrown downwardly at a deposit angle approximating the primary angle, said deposit angle being defined with respect to the food stick cut surface being sliced; and said feeding, slicing, engaging and angularly engaging steps combine to rapidly slice a flow of food sticks while substantially eliminating jamming of food sticks and their butt ends within the assemblies carrying out said feeding and slicing steps and while significantly reducing the amount of food waste generated during said feeding and slicing steps, irrespective of the temperature of the food sticks within a range of between about 10° F. and about 36° F.

30. The method in accordance with claim 29, wherein said large food sticks are refrigerated large sticks of luncheon meat at a temperature of between about 24° F. and about 36° F.

31. The method in accordance with claim 29, wherein said large sticks are large sticks of luncheon meat having a high water content of at least about 70 percent by weight, based on the weight of the stick.

32. The method in accordance with claim 29, wherein said large sticks are large sticks of luncheon meat having a fat content of about 10 percent by weight or less.

33. The method in accordance with claim 29, wherein said large sticks are large sticks of luncheon meat which have a high water content of at least about 70 percent by weight and a low fat content of about 10 percent by weight or less.

34. The method in accordance with claim 29, wherein said large food sticks are frozen or partially frozen large sticks of luncheon meat at a temperature of about 22° F. or below.

35. The method in accordance with claim 29, wherein the flat top surface has an average width of between about 0.1 inch and about 1 inch.

36. The method in accordance with claim 29, wherein the flat top surface has an average width of at least about 0.2 inch.

37. The method in accordance with claim 29, wherein said bottom primary bevel surface has an average width of between about 0.025 inch and about 0.200 inch.

38. The method in accordance with claim 29, further including laterally supporting the longitudinal side of the food stick and its butt end during said slicing step.

39. A method for slicing a stream of food sticks, comprising the steps of:

feeding, with the use of a feed assembly, a plurality of large food sticks toward and into a slicing location of a slicing assembly;

slicing at the slicing location the food sticks fed during the feeding step, said slicing step forming slices and a butt end from the food stick;

said slicing step including engaging a portion of the food stick being sliced with a blade having a top surface substantially parallel to the food stick cut surface being sliced;

said slicing step further including angularly engaging the portion of the food stick being sliced with a bottom primary bevel surface of the blade, the bottom primary bevel surface, together with the top surface, defining a primary angle of between about 45° and about 60°, the angularly engaging step causing each slice to be thrown downwardly at a deposit angle approximating the primary angle, said deposit angle being defined with respect to the food stick cut surface being sliced; and said feeding, slicing, engaging and angularly engaging steps combine to rapidly slice a flow of food sticks while substantially eliminating jamming of food sticks and their butt ends within the assemblies carrying out said feeding and slicing steps and while significantly reducing the amount of food waste generated during said feeding and slicing steps.

40. The method in accordance with claim 39, wherein said large food sticks are refrigerated large sticks of luncheon meat at a temperature of between about 24° F. and about 36° F.

41. The method in accordance with claim 39, wherein said large sticks are large sticks of luncheon meat having a high water content of at least about 70 percent by weight, based on the weight of the stick.

42. The method in accordance with claim 39, wherein said large sticks are large sticks of luncheon meat having a fat content of about 10 percent by weight or less.

43. The method in accordance with claim 39, whereas said large sticks are large sticks of luncheon meat which have a high water content of at least about 70 percent by weight and a low fat content of about 10 percent by weight or less.

44. The method in accordance with claim 39, wherein said large food sticks are frozen or partially frozen large sticks of luncheon meat at a temperature of about 22° F. or below.

45. The method in accordance with claim 39, wherein said bottom primary bevel surface has an average width of between about 0.025 inch and about 0.200 inch.

46. The method in accordance with claim 39, further including laterally supporting the longitudinal side of the food stick and its butt end during said slicing step.

* * * * *

UNITED STATES PATENT AND TRADEMARK OFFICE

CERTIFICATE OF CORRECTION

PATENT NO. : 6,267,033 B1
DATED : July 31, 2001
INVENTOR(S) : Gundlach et al.

It is certified that error appears in the above-identified patent and that said Letters Patent is hereby corrected as shown below:

Column 1,
Line 24, after “improved quality” insert -- and --.
Line 56, delete “hag” and insert -- has --.

Column 3,
Line 12, after “high performance” insert -- , --.

Column 4,
Line 14, delete “totalled” and insert -- totaled --.
Line 50, delete “+” and insert -- ± --.

Column 6,
Line 4, delete “have” and insert -- has --.

Column 8,
Line 4, delete “10weight” and insert -- 10 weight --.

Column 9,
Line 53, after “food sticks” insert -- , --.

Column 10,
Line 64, after “engaging” delete “in”.

Column 11,
Line 10, delete “steps” and insert -- step --.

UNITED STATES PATENT AND TRADEMARK OFFICE

CERTIFICATE OF CORRECTION

PATENT NO. : 6,267,033 B1
DATED : July 31, 2001
INVENTOR(S) : Gundlach et al.

It is certified that error appears in the above-identified patent and that said Letters Patent is hereby corrected as shown below:

Column 12,
Line 40, delete “whereas” and insert -- wherein --.

Signed and Sealed this

Fourth Day of June, 2002

*Attest:*

*Attesting Officer*

JAMES E. ROGAN
*Director of the United States Patent and Trademark Office*